US008065821B1

(12) United States Patent
Reid

(10) Patent No.: US 8,065,821 B1
(45) Date of Patent: Nov. 29, 2011

(54) FOOTWEAR WITH INTERCHANGEABLE DECORATIVE FEATURES

(76) Inventor: James A. Reid, Painter, VA (US)

( * ) Notice: Subject to any disclaimer, the term of this patent is extended or adjusted under 35 U.S.C. 154(b) by 497 days.

(21) Appl. No.: 12/317,539

(22) Filed: Dec. 24, 2008

(51) Int. Cl.
*A43B 3/24* (2006.01)

(52) U.S. Cl. ..... 36/100; 36/54; 36/1.5; 36/2 R

(58) Field of Classification Search ..... 36/15, 100, 36/101, 54, 109, 1.5, 2 R, 2 A, 2 B
See application file for complete search history.

(56) References Cited

U.S. PATENT DOCUMENTS

| | | | | | |
|---|---|---|---|---|---|
| 534,794 | A | * | 2/1895 | Higgins | 36/7.3 |
| 854,274 | A | * | 5/1907 | Crook et al. | 36/1.5 |
| 1,061,510 | A | * | 5/1913 | Weaser | 36/1.5 |
| 1,572,313 | A | * | 2/1926 | Sarar | 36/1.5 |
| 2,398,802 | A | * | 4/1946 | Morris | 36/1.5 |
| 2,607,133 | A | | 8/1952 | Marlowe | |
| 3,744,158 | A | | 7/1973 | Walker | |
| 3,983,642 | A | | 10/1976 | Liao | |
| 4,064,641 | A | | 12/1977 | Levine | |
| D280,567 | S | * | 9/1985 | Ji | D2/905 |
| 4,693,018 | A | | 9/1987 | Maleyko et al. | |
| 4,958,447 | A | * | 9/1990 | DuPree | 36/101 |
| 5,065,531 | A | * | 11/1991 | Prestridge | 36/100 |
| 5,109,614 | A | * | 5/1992 | Curry | 36/100 |
| D333,204 | S | | 2/1993 | Terrell | |
| D344,169 | S | | 2/1994 | Brown et al. | |
| 5,848,484 | A | * | 12/1998 | Dupree et al. | 36/101 |
| 6,851,203 | B2 | | 2/2005 | Roelofs | |
| 7,428,787 | B2 | * | 9/2008 | Crowley et al. | 36/2 R |

* cited by examiner

*Primary Examiner* — Marie Patterson
(74) *Attorney, Agent, or Firm* — Montgomery Patent and Design; Robert C. Montgomery; Joseph T. Yaksich

(57) ABSTRACT

Footwear with interchangeable components on the ankle area and tongue is herein disclosed, wherein both the replacement tongue and the upper area of the footwear comprise different materials, colors, or styles. The removal and replacement functionality is accomplished with a plurality of snap fasteners. To remove the upper portion of the footwear, the laces would be removed from the eyelets, an upper portion and tongue interchanged, and the laces replaced. It is also envisioned that the upper portion and tongue could be removed completely and shorter laces installed to transform the footwear into a pair of shoes as well.

13 Claims, 4 Drawing Sheets

FOOTWEAR WITH INTERCHANGEABLE DECORATIVE FEATURES

RELATED APPLICATIONS

The present invention was first described in a notarized Official Record of Invention on Nov. 13, 2007, that is on file at the offices of Montgomery Patent and Design, LLC, the entire disclosures of which are incorporated herein by reference.

FIELD OF THE INVENTION

The present invention relates generally to a footwear comprising removably attachable components on the ankle area and tongue and, more particularly, to a boot comprising a variety of upper tongues and upper boot assemblies comprising different materials, colors, or styles enabling said boot to transform into a shoe.

BACKGROUND OF THE INVENTION

Modern fashion trends dictate an ever evolving and changing of popularity wherein the clothing, shoes, and fashion accessories that are considered cutting edge today are considered passé tomorrow. In keeping with these trends, society has a strong desire to be different and is willing to be judged by the fashions that one wears. Thus, the fashion industry is in a constant search for new and innovative styles and solutions that will help to define the next fashion trend. Not limited strictly to clothing, this need for innovation extends to all areas of fashion, including that of accessories, such as shoes and boots. Accordingly, there is a constant need for new and innovative ideas that not only create new fashion styles, but also that invigorate the fashion industry. The development of the footwear herein described fulfills this need.

Footwear exists in many different discrete forms ranging from open toed sandals to full length boots. Many people expend great amounts of money on their choice of footwear. Many find it difficult to maintain a fashion "edge" while being economical. An article of footwear that comprises a detachable upper assembly would provide an economical means while remaining fashion conscious.

There have been attempts in the past to invent boots that convert into shoes. U.S. Pat. No. 6,851,203 issued to Roelofs discloses footwear with attachable clothing that may be useful in the event of biological, chemical or radiation attacks. Unfortunately, this patent does not appear to disclose footwear with interchangeable decorative features such as a detachable upper assembly and detachable upper tongue that may coordinate to suit a user's fashion sense.

U.S. Pat. No. D 344,169 issued to Brown appears to disclose a convertible tennis shoe. Unfortunately, this design patent does not appear to be similar in appearance to the disclosed device, nor does it appear to teach a detachable upper assembly and detachable tongue that use fasteners to attach to a lower boot assembly.

U.S. Pat. No. D 333,204 issued to Terrell discloses a sneaker with a cowl like upper. Unfortunately, this design patent does not appear to be similar in appearance to the disclosed device, nor does it appear to teach footwear with interchangeable decorative features such as a detachable upper assembly that may be changed to reflect a user's personal fashion taste.

U.S. Pat. No. D 280,567 issued to Ji discloses what appears to be a sneaker with a zippered detachable upper. Unfortunately, this design patent does not appear to be similar in appearance to the disclosed device, nor does it appear to comprise an upper section with a plurality of eyelets and a detachable upper tongue section.

U.S. Pat. No. 4,693,018 issued to DuPree discloses a detachable upper for a sneaker comprising a hook and loop fastener. Unfortunately, this patent does not disclose footwear with multiple interchangeable decorative features such as upper assemblies and tongues that may be added to reflect one's fashion sense, nor does it appear to disclose an upper that comprises eyelets and other features to discretely disguise the addition of the upper assembly to an article of footwear.

U.S. Pat. No. 4,958,447 issued to Maleyko et al. discloses an athletic shoe with break-away high top that appears to attach to a shoe through hook-and-loop fasteners. Unfortunately, this patent does not disclose footwear with multiple interchangeable decorative features such as upper assemblies and tongues that may be added to reflect one's fashion sense, nor does it appear to disclose an upper that comprises eyelets and other features to discretely disguise the addition of the upper assembly to an article of footwear.

U.S. Pat. No. 4,064,641 issued to Levine discloses an article of footwear with a cuff like section on the upper part of the footwear. Unfortunately, this patent does not appear to disclose an article of footwear with a detachable, interchangeable upper assembly and upper tongue.

U.S. Pat. No. 3,983,642 issued to Liao discloses a shoe having interchangeable uppers. Unfortunately, this patent does not appear to disclose footwear with interchangeable decorative features such as a detachable upper assembly and detachable upper tongue that may coordinate to suit a user's fashion sense.

U.S. Pat. No. 3,744,158 issued to Walker discloses a sportsmen's boot with a detachable extension. Unfortunately, this patent does not disclose footwear with multiple interchangeable decorative features such as upper assemblies and tongues that may be added to reflect one's fashion sense, nor does it appear to disclose an upper that comprises eyelets and other features to discretely disguise the addition of the upper assembly to an article of footwear.

U.S. Pat. No. 2,607,133 issued to Marlowe discloses a shoe with detachable upper. Unfortunately, this patent does not appear to disclose footwear with interchangeable decorative features such as a detachable upper assembly and detachable upper tongue that may coordinate to suit a user's fashion sense.

U.S. Pat. No. 854,274 issued to Crook et al. discloses an attachment for shoes that appears to comprise an upper that utilizes snap fasteners to attach to a shoe. Unfortunately, this patent does not disclose footwear with multiple interchangeable decorative features such as upper assemblies and tongues that may be added to reflect one's fashion sense, nor does it appear to disclose an upper that comprises eyelets and other features to discretely disguise the addition of the upper assembly to an article of footwear.

None of the prior art particularly describes a footwear with removably attachable components on the ankle area and tongue that the instant device possesses. Accordingly, there exists a need for a line of boots that operates without the disadvantages as described above.

SUMMARY OF THE INVENTION

In light of the disadvantages as previously discussed in the prior art; it is apparent that there is a need for a means and system for providing an article of footwear comprising interchangeable and removable tops and tongues to create different stylish looks and color schemes.

An object of the article of footwear comprising interchangeable decorative features is to provide footwear that is capable of being changed from boots to shoes.

Another object of the article of footwear comprising interchangeable decorative features is to provide snaps and fasteners that hold the upper securely to the footwear.

A further object of the article of footwear comprising interchangeable decorative features is to permit a user to customize the look of their footwear.

Still another object of the article of footwear comprising interchangeable decorative features is to provide upper boot assemblies and tongue portions that may be purchased individually or as sets in matching color and pattern schemes to provide more fashion choices to a user.

Still a further object of the article of footwear comprising interchangeable decorative features is to provide footwear in all standard men's, women's and children's sizes.

An aspect of the article of footwear comprising interchangeable decorative features is that it may be worn solely as the lower boot assembly for a low cut shoe appearance or with one of the upper assemblies for the look of a boot.

Another aspect of the article of footwear comprising interchangeable decorative features comprises a detachable first upper boot assembly comprising a first upper ankle enclosure, a plurality of snap fastener studs, a removably attachable first tongue, and a plurality of lacing eyelets.

Yet a further aspect of the article of footwear comprising interchangeable decorative features comprises a lower boot assembly comprising standard and expected features such as a toe section, a heel section, a sole, a lace, and a plurality of lacing eyelets. The lower boot assembly further comprises a border providing a reinforcing and strengthening means thereto the snap fastener sockets. The border is envisioned to be made using strong materials affixed to an upper outer edge of the heel section.

Yet another aspect of the article of footwear comprising interchangeable decorative features comprises a second upper boot assembly, and a second tongue. The second upper boot assembly and second tongue portions comprise a similar shape and form as the aforementioned first upper boot assembly and first tongue and provide an unlimited fashion combination by varying one (1) more features such as, but not limited to: shape, height, color, material, style, and the like, thereby providing a user an assortment of attractive boot appearances.

A method of utilizing an article of footwear comprising interchangeable decorative features may be achieved by performing the following steps: selecting the first upper boot assembly and first tongue portions of the footwear having a desired footwear design, and color; obtaining the footwear as a pair of boots comprising a needed shoe size; purchasing one (1) or more second upper boot assemblies, tongues, and coordinating laces in expected left and right boot portions having additional designs, colors, patterns, and heights, based upon a user's preference; wearing the footwear, if so desired, in an as-obtained state having matching lower and first upper boot assemblies; reconfiguring the footwear by removing the first upper boot assemblies, first tongues, and laces; installing a particular pair of desired second upper boot assemblies and desired laces; wearing the now reconfigured footwear in a normal manner; continuing to periodically reconfigure the footwear based upon particular activities, destinations, or a user's preference, as desired; wearing the footwear with the upper boot assemblies removed, thereby creating a shoe configuration of the lower boot assembly, as desired; and, enjoying a creative footwear means which provides many configurable appearances, designs, patterns, and colors.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | article of footwear comprising interchangeable decorative features |
| 20 | first upper boot assembly |
| 22 | first upper ankle enclosure |
| 25 | second upper boot assembly |
| 27 | second upper ankle enclosure |
| 30 | snap fastener stud |
| 32 | snap fastener socket |
| 35 | border |
| 40 | first upper tongue |
| 45 | second upper tongue |
| 47 | lower tongue |
| 50 | lower boot assembly |
| 53 | toe section |
| 55 | heel section |
| 60 | sole |
| 70 | lace |
| 72 | short lace |
| 75 | eyelet |

DETAILED DESCRIPTION OF THE PREFERRED EMBODIMENT

Figure 1:
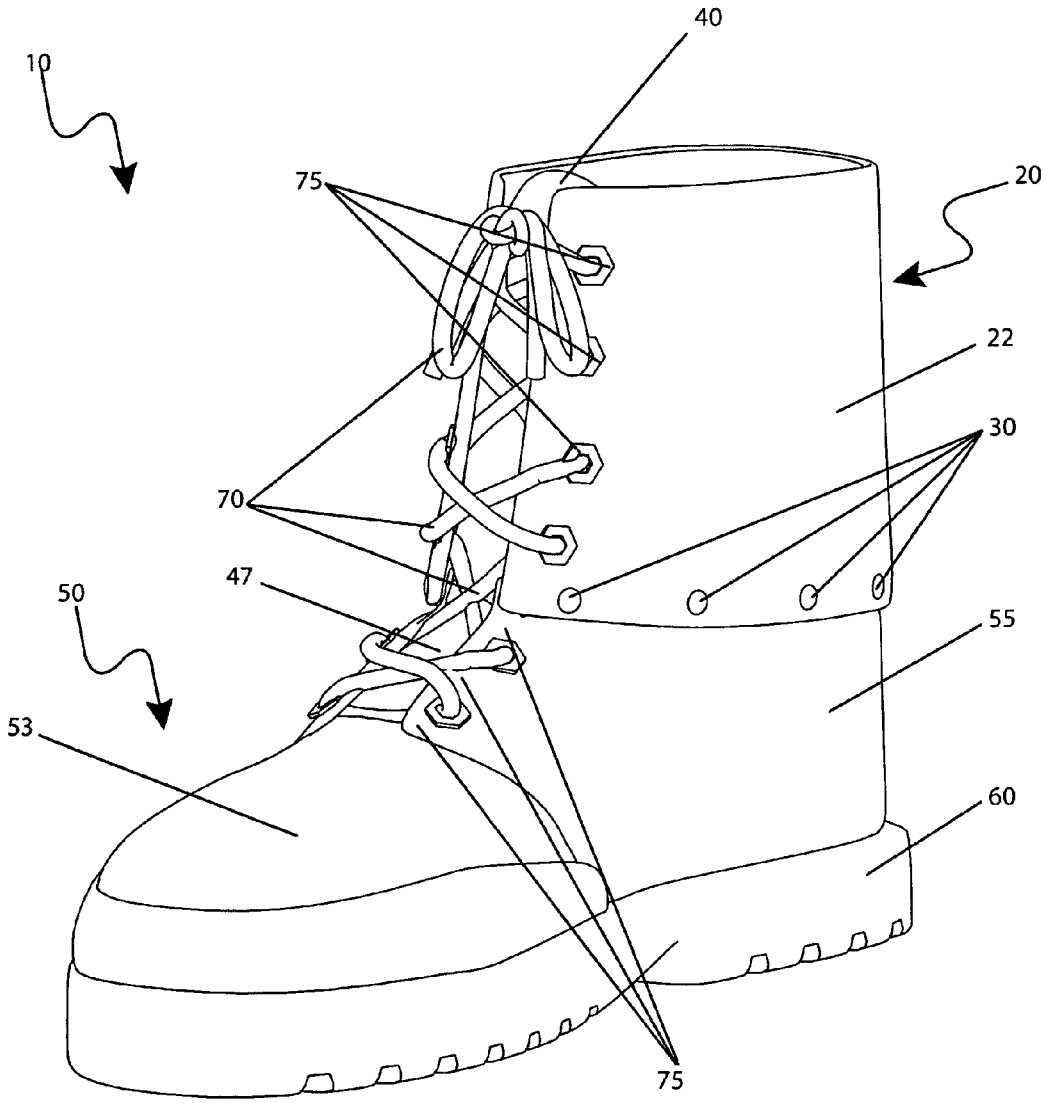
FIG. 1 is a side perspective view of an article of footwear comprising interchangeable decorative features 10, according to a preferred embodiment of the present invention.
Figure 2A:
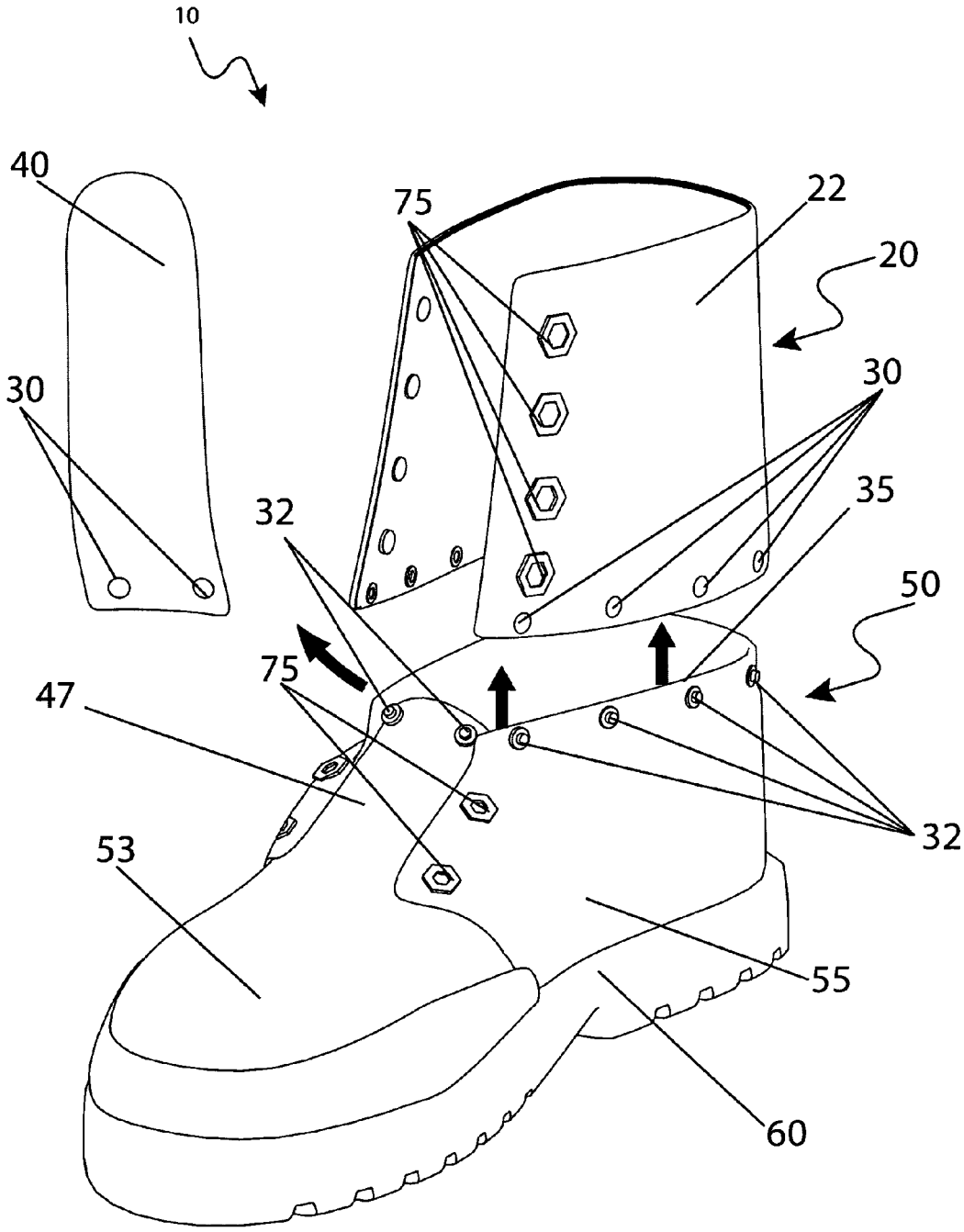
FIG. 2*a* is an exploded view of an article of footwear comprising interchangeable decorative features 10, according to a preferred embodiment of the present invention.
Figure 2B:
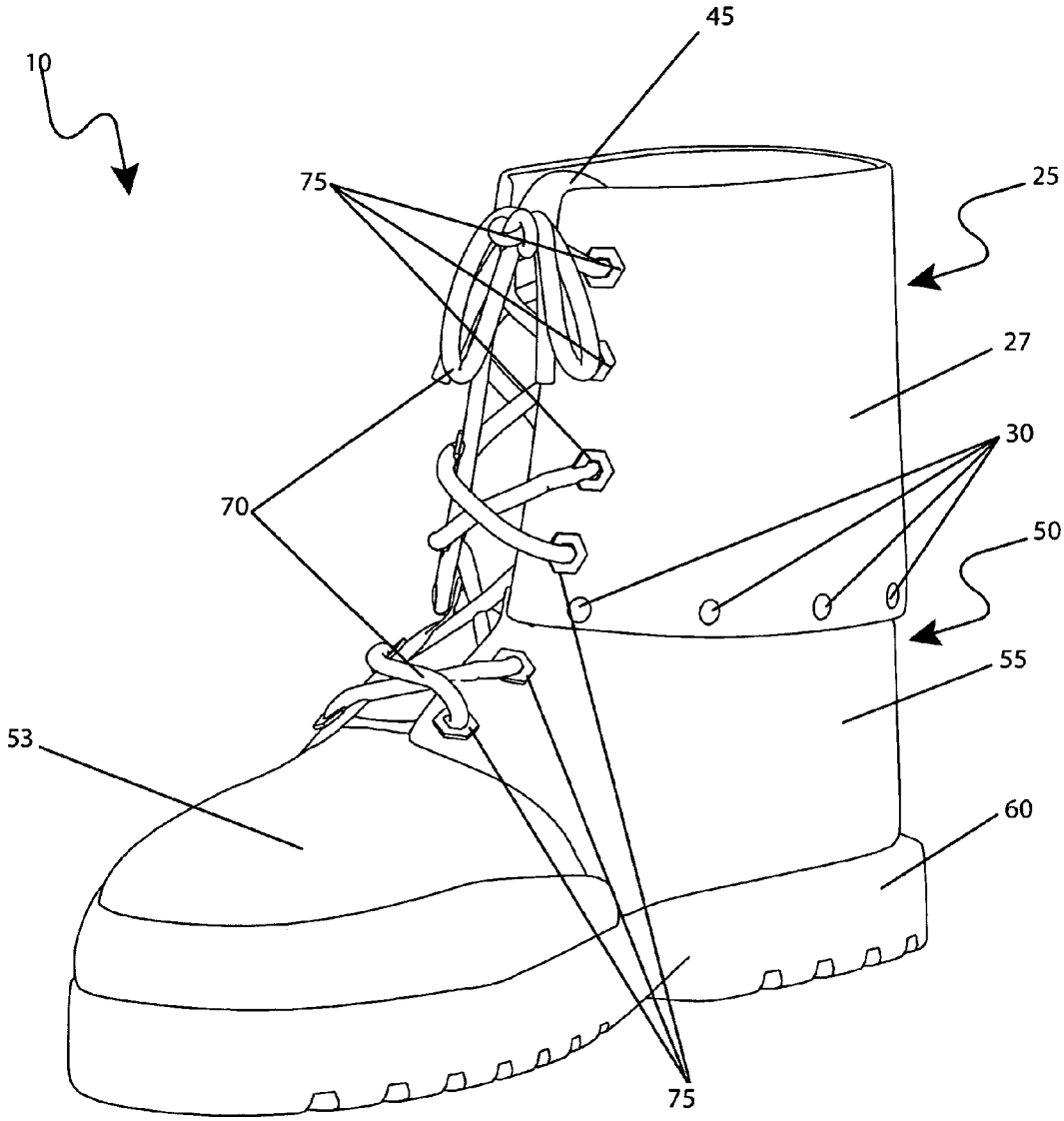
FIG. 2*b* is a side perspective view of an article of footwear comprising interchangeable decorative features 10 depicting a transformed state, according to a preferred embodiment of the present invention; and, FIG. 3 is a perspective view of an article of footwear comprising interchangeable decorative features depicting a shoe embodiment 50, according to a preferred embodiment of the present invention.
Figure 3:
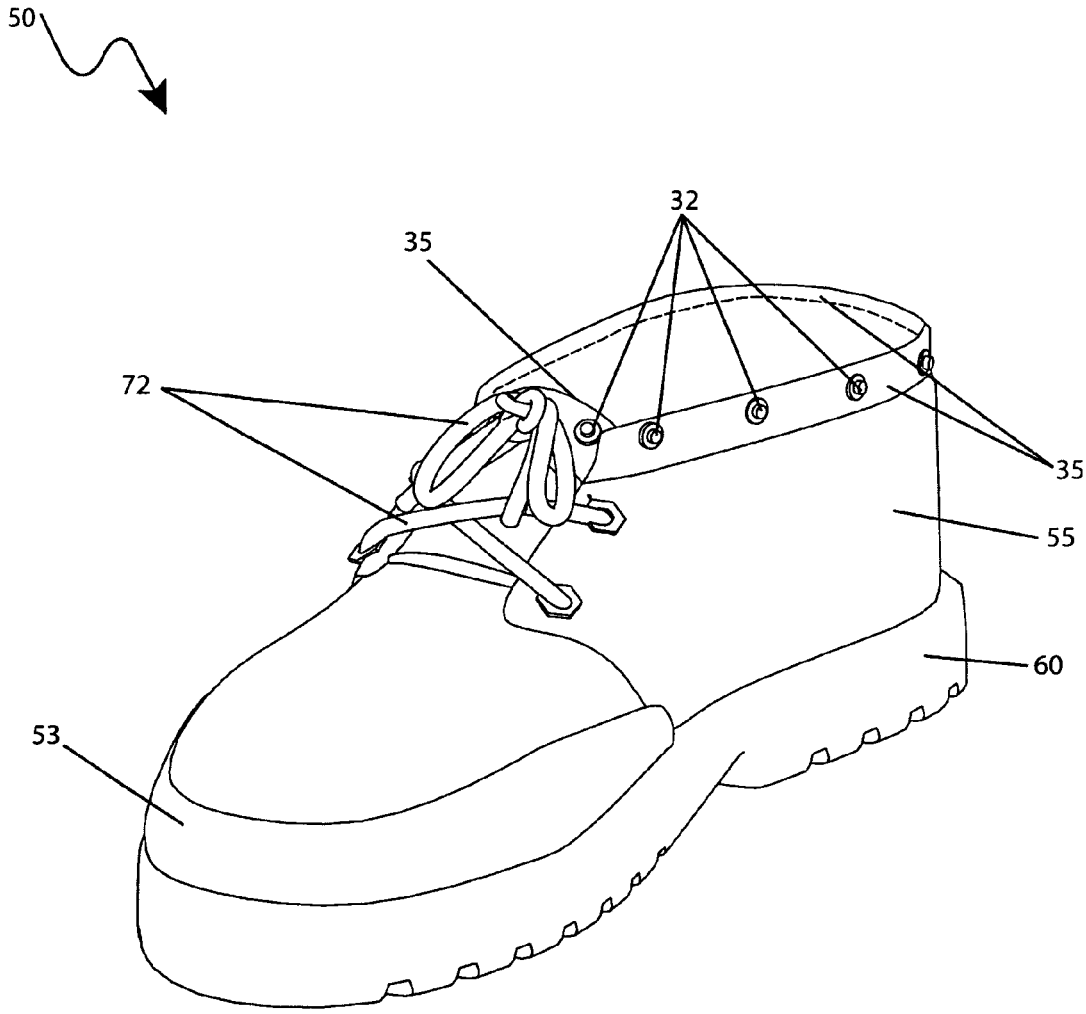

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an article of footwear comprising interchangeable decorative features (herein described as the "apparatus") 10, which provides a line of boots with interchangeable components on ankle and tongue areas wherein both the first upper tongue 40 and the upper area of the boot 20 are interchangeable with different textiles or materials, is herein disclosed. The removal and replacement functionality is accomplished via a plurality of snap fasteners 30. To remove the upper portion of the boot 20, the laces 70 would be removed from the eyelets 75, the upper boot 20 interchanged, the tongue portion 40 interchanged, and then the laces 70 replaced. The apparatus 10 may also be provided with the upper boot 20 removed completely and shorter laces 70 installed to reconfigure the apparatus 10 thereinto a shoe style.

Referring now to FIG. 1, a side perspective view of the apparatus 10, according to the preferred embodiment of the present invention, is disclosed. The apparatus 10 comprises a removably attachable first upper boot assembly 20, a plurality of snap fastener studs 30, a first upper tongue 40, and a lower boot assembly 50. The apparatus 10 is illustrated here being utilized thereupon a common work boot; however, various styles of boots may be provided having various features such as, but not limited to: different heights, various lace designs, alternate frontal closure means such as hook-and-loop fasteners, and the like, while providing equal benefit thereto a user. It is understood that the apparatus 10 is to be provided in all men's, women's, and children's standard shoe sizes. It is further understood that the apparatus 10 is to be purchased as a pair of boots having a first upper boot assembly 20 and one (1) or more second upper boot assemblies 25 (see FIG. 2*b*). The work boot type lower assembly 50 depicted here comprises of standard and expected features such as a toe section 53, a heel section 55, a sole 60, a lace 70, and a plurality of lacing eyelets 75. The detachable first upper boot portion 20 further comprises a first upper ankle enclosure 22, a plurality of snap fastener studs 30, a first upper tongue 40, and a plurality of lacing eyelets 75. Once the first upper boot assembly 20 and first upper tongue 40 are attached thereto the lower boot assembly 50 and a lower tongue portion 47, the laces 70 are to be installed in a conventional manner and the apparatus 10 may function as a normal boot. However, said first upper boot assembly 20, first upper tongue 40, and laces 70 may be replaced therewith portions providing a variety of attractive styles and designs (see FIGS. 2*a* and 2*b*).

Referring now to FIG. 2*a*, an exploded view of the apparatus 10, according to the preferred embodiment of the present invention, is disclosed. The apparatus 10 comprises a removably attachable first upper tongue 40, a plurality of snap fastener studs 30, and a plurality of snap fastener sockets 32. The first upper tongue portion 40 comprises a common boot element being easily detachable therefrom the lower tongue 47 using two (2) or more snap fastener studs 30 and corresponding snap fastener sockets 32 arranged along a lower joining edge. Additionally, a plurality of equally-spaced snap fastener sockets 32 are arranged along an upper edge of the heel section 55 of the lower boot assembly 50 having corresponding locations thereto a plurality of snap fastener studs 30 along a lower edge of the first upper boot assembly 20 providing a secure and stable attachment means when snapped together in an expected manner. The snap fastener studs 30 are envisioned to be installed along an inner surface of the first upper boot assembly 20 enabling said fasteners 30, 32 to be discreetly hidden therebetween the first upper boot assembly 20 and lower boot assembly 50 during use. The lower boot assembly 50 further comprises a border 35 providing a reinforcing and strengthening means thereto the snap fastener sockets 32. The border is envisioned to be made using strong materials such as polyvinylchloride (PVC), leather, or the like being affixed thereto an upper outer edge of the heel section 35 using standard textile sewing techniques. The snap fasteners 30, 32 comprise common prong-type devices being common in the industry and having a diameter of approximately one-half (') inch, thereby providing a firm attachment thereto said boot assemblies 20, 50. The first upper tongue 40 and first upper boot assembly 20 are envisioned to have a matching color to that of the lower boot assembly 50, thus appearing to be a conventional pair of boots.

Referring now to FIG. 2*b*, a side perspective view of the apparatus 10 depicting a transformed state, according to the preferred embodiment of the present invention, is disclosed. The apparatus 10 comprises a second upper boot assembly 25, and a second upper tongue 45. The appearance of the apparatus 10 as illustrated here has been transformed due to an installation of a second upper boot assembly 25 and second upper tongue 45 providing different fashion features. The second upper boot assembly 25 and second upper tongue portions 45 are depicted here comprising a similar shape and form as the aforementioned first upper boot assembly 20 and first upper tongue 40; however, it is envisioned that said second upper boot assembly 25 and second upper tongue portions 45 may provide an unlimited number of fashion combination by varying one (1) more features such as, but not limited to: shape, height, color, material, style, and the like, thereby providing a user an assortment of attractive boot appearances. Furthermore, it is understood that any number of second upper boot assemblies 25 and second upper tongue portions 45 may be purchased individually or as a sets in addition thereto the first upper boot assembly 20, first upper tongue 40, and lower boot assembly 50. It is further envisioned that additional laces 70 and/or other desired fashion accessories may also be provided therewith purchase of the second upper boot assemblies 25 having matching color and pattern schemes providing yet more fashion combinations thereto a user.

Referring now to FIG. 3, a perspective view of the apparatus 10 depicting a shoe embodiment, according to the preferred embodiment of the present invention, is disclosed. The apparatus 10 is illustrated here being further transitioned thereinto a shoe configuration comprising only the lower boot assemblies 50 worn in a stand-alone state with short laces 72 being installed and having the first upper boot assembly 20 removed, thereby providing yet another appearance, if so desired.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1 through 3.

The method of utilizing the apparatus 10 may be achieved by performing the following steps: selecting the first upper boot assembly 20 and first upper tongue portions 40 of the apparatus 10 having a desired footwear design, and color; obtaining the apparatus 10 as a pair of boots comprising a needed shoe size; purchasing one (1) or more second upper boot assemblies 50, tongues 40, and coordinating laces 70 in expected left and right boot portions having additional designs, colors, patterns, and heights, based upon a user's preference; wearing the apparatus 10, if so desired, in an as-obtained state having matching lower 50 and first upper 20 boot assemblies; reconfiguring the apparatus 10 by removing the first upper boot assemblies 20, first upper tongues 40, and laces 70; installing a particular pair of desired second upper boot assemblies 50 and desired laces 70; wearing the now reconfigured apparatus 10 in a normal manner; continuing to periodically reconfigure the apparatus 10 based upon particular activities, destinations, or a user's preference, as desired; wearing the apparatus 10 with the upper boot assemblies 20, 50 removed, thereby creating a shoe configuration of the lower boot assembly 50, as desired; and, enjoying a creative footwear means which provides many configurable appearances, designs, patterns, and colors.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An article of footwear comprising interchangeable components, further comprising:

a lower boot assembly, comprising:

a plurality of lower lacing eyelets; and, a receiving connecting means located along an outer upper edge of said lower boot assembly;

an upper boot assembly removably attachable thereto said lower boot assembly, comprising:

a plurality of upper lacing eyelets; and, a connecting means located along an inner lower edge of said upper boot assembly and removably attachable thereto said receiving connecting means of said lower boot, assembly;

a lower tongue comprising a tongue receiving connecting means located along an outer upper tongue edge; and, an upper tongue removably attachable thereto said lower tongue, comprising:

a tongue connecting means located along an inner lower tongue edge and removably attachable thereto said tongue receiving connecting means of said lower tongue;

wherein said footwear comprises a boot configuration when said upper tongue is attached thereto said lower tongue and said upper boot assembly is attached thereto said lower boot assembly; and, wherein said footwear comprises a shoe configuration when Said upper tongue is removed therefrom said lower tongue and said upper boot assembly is removed therefrom said lower boot assembly.

2. The footwear of claim 1, wherein said boot configuration further comprises a lace that removably threads therethrough said plurality of lower lacing eyelets and said plurality of upper lacing eyelets.

3. The footwear of claim 1, wherein said shoe configuration further comprises a short lace that removably threads therethrough said plurality of lower lacing eyelets.

4. The footwear of claim 1, wherein said connecting means and said tongue connection means comprise a plurality of snap fasteners.

5. The footwear of claim 4, wherein said receiving connecting means and said tongue receiving connecting means comprise a plurality of snap fastener sockets.

6. The footwear of claim 1, wherein said connecting means and said tongue connection means comprise a plurality of loop portions.

7. The footwear of claim 6, wherein said receiving connecting means and said tongue receiving connecting means comprise a plurality of hook portions.

8. The footwear of claim 1, wherein said lower boot assembly further comprises a border located around said outer upper edge, thereby providing a strengthening means thereto said receiving connecting means.

9. The footwear of claim 8, wherein said border comprises a polyvinylchloride material.

10. The footwear of claim 1, wherein said upper boot assembly and said upper tongue are available in a variety of shapes, heights, colors, materials, and styles, thereby providing a means wherein a user can vary an appearance of said boot configuration.

11. The footwear of claim 1, wherein said footwear is available in a variety of shoe sizes.

12. The footwear of claim 1, wherein said footwear is available in both a left boot and a right boot.

13. A method for converting an article of footwear comprising interchangeable components, said method comprising the steps of providing said footwear, comprising:

a lower boot assembly, comprising:

a plurality of lower lacing eyelets; and, a receiving connecting means located along an outer upper edge of said lower boot assembly;

an upper boot assembly removably attachable thereto said lower boot assembly, comprising:

a plurality of upper lacing eyelets; and, a connecting means located along an inner lower edge of said upper boot assembly and removably attachable thereto said receiving connecting means of said lower boot assembly;

a lower tongue comprising a tongue receiving connecting means located along an outer upper tongue edge; and, an upper tongue removably attachable thereto said lower tongue, comprising:

a tongue connecting means located along an inner lower tongue edge and removably attachable thereto said tongue receiving connecting means of said lower tongue;

wherein said footwear comprises a boot configuration when said upper tongue is attached thereto said lower tongue and said upper boot assembly is attached thereto said lower boot assembly; and, wherein said footwear comprises a shoe configuration when said upper tongue is removed therefrom said lower tongue and said upper boot assembly is removed therefrom said lower boot assembly;

selecting said upper boot assembly and said upper tongue of said footwear having a desired footwear design, and color;

obtaining said footwear comprising a needed shoe size;

purchasing additional upper boot assemblies and upper tongues, and a lace in expected left and right boot portions having additional designs, colors, patterns, and heights, based upon a user's preference;

reconfiguring said footwear by removing said upper boot assembly, said upper tongue, and said lace;

installing a particular pair of desired upper boot assembly and a particular pair of upper tongues, and a particular lace;

wearing the now reconfigured footwear in a normal manner;

continuing to periodically reconfigure said footwear based upon particular activities, destinations, or a user's preference, as desired;

wearing said footwear with said upper boot assembly and said upper tongue removed, thereby creating said shoe configuration, as desired; and, enjoying a creative footwear means which provides many configurable appearances, designs, patterns, and colors.

* * * * *